US011992866B2

(12) United States Patent
Daube et al.

(10) Patent No.: US 11,992,866 B2
(45) Date of Patent: May 28, 2024

(54) METHOD FOR THE ONLINE DETERMINATION OF AT LEAST ONE ROLLING PARAMETER, AND ROLLING MILL WITH A DEVICE FOR THE ONLINE DETERMINATION OF AT LEAST ONE ROLLING PARAMETER

(71) Applicant: SMS group GmbH, Duesseldorf (DE)

(72) Inventors: Thomas Daube, Moenchengladbach (DE); Thomas Nerzak, Moechengladbach (DE); Joerg Himmel, Muehlheim an der Ruhr (DE); Annette Jobst, Muehlheim an der Ruhr (DE); Mario Radschun, Muehlheim an der Ruhr (DE)

(73) Assignee: SMS group GmbH, Duesseldorf (DE)

( * ) Notice: Subject to any disclaimer, the term of this patent is extended or adjusted under 35 U.S.C. 154(b) by 42 days.

(21) Appl. No.: 17/625,800

(22) PCT Filed: Jun. 15, 2020

(86) PCT No.: PCT/DE2020/100493
§ 371 (c)(1),
(2) Date: Jan. 10, 2022

(87) PCT Pub. No.: WO2021/032233
PCT Pub. Date: Feb. 25, 2021

(65) Prior Publication Data

US 2022/0258221 A1 Aug. 18, 2022

(30) Foreign Application Priority Data

Aug. 16, 2019 (DE) ..... 10 2019 122 129.3
Aug. 20, 2019 (DE) ..... 10 2019 122 381.4
Nov. 28, 2019 (DE) ..... 10 2019 132 389.4

(51) Int. Cl.
*B21B 37/16* (2006.01)

(52) U.S. Cl.
CPC ..... *B21B 37/165* (2013.01)

(58) Field of Classification Search
CPC ..... B21B 37/007; B21B 37/16; B21B 37/165; B21B 37/48; B21B 38/008;
(Continued)

(56) References Cited

U.S. PATENT DOCUMENTS 3,142,796 A * 7/1964 Goldberg ..... A61B 5/0265 336/20
3,148,563 A * 9/1964 Harley ..... B23D 36/00 83/370
(Continued)

FOREIGN PATENT DOCUMENTS

DE 696 04 233 T2 1/2000
DE 100 07 364 A1 3/2001
(Continued)

OTHER PUBLICATIONS

EP 1710534A1, Himmel et al. Oct. 2006.*
(Continued)

*Primary Examiner* — Edward T Tolan
(74) *Attorney, Agent, or Firm* — Collard & Roe, P.C.

(57) ABSTRACT

In a method for the online determination of at least one rolling parameter when rolling a rolling material rolled along a rolling line in a rolling mill including at least two rolls on a roll stand, the rolling material is guided past or through at least one measuring device during the rolling, which interacts with a rolling material variable of the rolling material, the rolling material variable being changeable along the length of the rolling material, and outputs a measurement signal, wherein: (i) the measurement signal is transferred into the frequency space, and the rolling parameter is determined from the measurement signal transferred into the frequency space, and/or (ii) a frequency inherent in
(Continued)

the change of the rolling material variable is determined from the measurement signal, and the rolling parameter is determined on the basis of the determined frequency.

16 Claims, 2 Drawing Sheets

(58) Field of Classification Search
CPC ..... B21B 2265/06; B21B 38/00; B21B 38/04; B21B 38/08; B21B 2261/10; B21B 2275/04; B21B 2275/06
See application file for complete search history.

(56) References Cited

U.S. PATENT DOCUMENTS

| | | | | |
|---|---|---|---|---|
| 3,646,789 | A * | 3/1972 | Forster | B21C 51/005 324/237 |
| 3,862,558 | A * | 1/1975 | Yoshitani | B21B 38/04 72/8.9 |
| 4,309,902 | A * | 1/1982 | Sano | B21B 38/02 73/159 |
| 4,763,500 | A * | 8/1988 | Schoen | G01V 3/101 72/12.5 |
| 5,799,526 | A | 9/1998 | Mieze et al. | |
| 6,349,581 | B1 | 2/2002 | Palzer et al. | |
| 10,197,533 | B2 | 2/2019 | Nerzak et al. | |

FOREIGN PATENT DOCUMENTS

| | | | |
|---|---|---|---|
| DE | 10 2015 119 548 | A1 | 1/2017 |
| EP | 1 889 670 | A1 | 2/2008 |
| JP | S48-73356 | A | 10/1973 |
| WO | 2017/025910 | A1 | 2/2017 |

OTHER PUBLICATIONS

UA 86871C2, Kummerling et al. May 2009.*
English translation of the International Preliminary Report on Patentability in PCT/DE2020/100493, dated Dec. 18, 2020.
German Search Report dated Apr. 20, 2020 in German Application No. 10 2019 132 389.4 with English translation of relevant parts.
SMS Group: Trends at the Tube & Wire, Newsletter edition Feb. 2016, total of 49 pages.
M. Radschun, A. Jobst, J. Himmel and O. Kanoun, "Non-contacting Velocity Measurements of Hot Rod and Wire Using Eddy-Current Sensors", 2019 IEEE Workshop 2019, Mülheim a. d. Ruhr, pp. 34-35.
International Search Report of PCT/DE2020/100493, dated Sep. 11, 2020.
R. Hinkfoth (Bulk forming process, Aachen, Wissenschaftsverlag Mainz, 2003), 11 pages, with English translation of relevant pp. 138-139.
J. Weidemüller, "Optimization of Encircling Eddy Current Sensors for Online Monitoring of Hot Rolled Round Steel Bars", vol. 3, 2014, 81 pages.

* cited by examiner

METHOD FOR THE ONLINE DETERMINATION OF AT LEAST ONE ROLLING PARAMETER, AND ROLLING MILL WITH A DEVICE FOR THE ONLINE DETERMINATION OF AT LEAST ONE ROLLING PARAMETER

CROSS REFERENCE TO RELATED APPLICATIONS

This application is the National Stage of PCT/DE2020/100493 filed on Jun. 15, 2020, which claims priority under 35 U.S.C. § 119 of German Application No. 10 2019 122 129.3 filed on Aug. 16, 2019, German Application No. 10 2019 122 381.4 filed on Aug. 20, 2019, and German Application No. 10 2019 132 389.4 filed on Nov. 28, 2019, the disclosures of which are incorporated by reference. The international application under PCT article 21(2) was not published in English.

BACKGROUND OF THE INVENTION

1. Field of the Invention

The invention relates to a method for the online detection of at least one rolling parameter when rolling rolled material rolled along a rolling line of a rolled material within a rolling mill comprising at least two rollers on a rolling stand, where the rolled material is guided past at least one measurement device during rolling or passed through it, which interacts with a varying rolled material parameter along the longitudinal extension of the rolled material and outputs a measurement signal. The invention also relates to a rolling mill comprising at least two rollers arranged on a rolling stand for rolling rolled material along a rolling line as well as with a device for online detection of at least one rolling parameter, wherein the detection device comprises at least one measurement device which is arranged on the rolling line and which can interact with a varying rolling parameter of the rolled material along the longitudinal extension of the rolled material and can output a measurement signal.

2. Description of the Related Art

When rolling in a rolling mill, as a rule, a rolled material, which can be, for example, a metal sheet, a slab, a block, a hollow block, a hollow or a rod, a wire or pipe, is passed by or passed through at least one rolling stand, which carries at least two rollers and acts accordingly on the rolled material that is passed by or passed through. It is well known that such rolling stands, depending on the specific rolling mill, can also support more than two rollers, which do not necessarily all have a forming effect on the rolled material. Rather, the rollers can also only interact with the rolled material in a propulsive or guiding manner, as long as at least two rollers have a corresponding forming effect on the rolled material.

Accordingly, in particular, a plurality of rolling stands can also be provided, wherein each of the rolling stands is adapted to certain functionalities and can support corresponding rollers.

As a rule, rolling takes place under relatively adverse environmental conditions since the rolled material is usually only sufficiently formable at relatively high temperatures. In the vicinity of such a rolling mill, there are also high proportions of scale, dust, steam, etc. As a result, it is a relatively large challenge to monitor a rolling process online, particularly since the rolled material is usually also guided past or through the rolling stands at relatively high speeds along the rolling line so that corresponding measurement results must be provided in a relatively short time if these are to be considered detected online.

For example, from DE 10 2015 119 548 A1, a measurement device is known which, due to its structural structure and cooling, enables a measurement of a rolled material parameter of the rolled material, which changes along the longitudinal extension of the rolled material even under relatively adverse environmental conditions, such as high temperatures, scale, steam and dust. It is to be understood that there are also other approaches in the prior art to measure rolled material variables along the longitudinal extension of the rolled material.

In particular, J. Weidemüller, ("Optimization of Encircling Eddy Current Sensors for Online Monitoring of Hot Rolled Round Steel Bars", 2014, ISBN 9783844027945), SMS group Unternehmenskommunikation (newsletter Das Magazin by the SMS Group, Issue 02/2016", 2016, Düsseldorf) and M. Radschun, A. Jobst, O. Kanoun, J. Himmel ("Non-contacting Velocity Measurements of Hot Rod and Wire Using Eddy-Current Sensors", 2019 IEEE Workshop 2019, Mülheim a. d. Ruhr) disclose impedance sensors, by means of which parameter cross-sectional area changes of the rolled material can be measured along the longitudinal extension of the rolled material. R. Hinkfoth (Bulk forming process, Aachen, Wissenschaftsverlag Mainz, 2003) also discloses an offline measurement of the peripheral precession of the rolled material when it leaves a rolling groove.

SUMMARY OF THE INVENTION

It is an object of the present invention to provide a method for the online detection of at least one rolling parameter and a rolling mill with a device for the online detection of at least one rolling parameter, which can provide a rolling parameter online relatively easily and reliably.

The object of the invention is solved by means of a method for the online detection of at least one rolling parameter and by means of a rolling mill with a device for online detection of at least one rolling parameter with the features of the independent claims. Furthermore, if necessary, also independent of this, favorable embodiments can be found in the subclaims as well as the following description.

Thus, a method for the online detection of at least one rolling parameter when rolling a rolled material rolled along a rolling line within a rolling mill comprising at least two rollers on a rolling stand, where the rolled material is guided past at least one measurement device during rolling or, if applicable, also passed through it, which interacts with a varying rolled material parameter of the rolled material parameter along the longitudinal extension of the rolled material and outputs a measurement signal can be characterized in that the measurement signal transfers into the frequency space and the rolling parameter is detected from the measurement signal transferred into the frequency space in order to be able to make the rolling parameter available online in a relatively easily and reliably manner.

If the rolled material with its varying rolled material parameter along its longitudinal extension passes through the measurement device, a measurement signal follows if the rolled material parameter changes accordingly. The transfer of the measurement signal into the frequency space then enables a simple and relatively reliable frequency analysis of the measurement signal. On the basis of this frequency analysis or on the basis of the measurement signal transferred out into frequency space, rolling parameters can then be detected, if necessary, by assuming that, although the rolled material should ideally be uniformly formed along its longitudinal extension, deviations from this uniformity can be detected and used to determine the rolling parameter. This applies, in particular, if it is assumed that the rollers act on the rolled material with a certain regularity, which is due to their rotation or revolution. Corresponding roundness or other markings or the like of the rollers then require correspondingly fluctuating measurement signals, wherein, in the frequency space, an assignment of individual frequencies to certain rollers or to a rolling stand supporting these rollers can be made. Such an assignment can be made relatively simply and reliably in the frequency space so that, after this assignment, the rolling parameters can also be provided online in a relatively easy and reliable manner.

In particular, it has been found that significant frequency peaks of the measurement signal transferred into the frequency space are often caused by the action of one or a plurality of rollers of the rolling stand arranged directly in front of the measurement device providing the measurement signal. This can be caused, for example, by self-elasticity, minor roundness or minimal errors of the rollers, but also by the natural frequencies of the rolling stand and other influences.

It is to be understood that any suitable space equipped with frequencies as units can be used as a frequency space in which the measurement signal recorded over time, i.e., the measurement signal initially recorded in the period, can be transferred in a sufficiently reliable but also sufficiently fast manner. In particular, a transfer by means of a Fourier transformation is recommended here, wherein it can make sense to ultimately choose the frequency space since very high frequencies and also very low frequencies can no longer be expected to make any relevant assertions. Fast Fourier transformations or similar transformations, which enable a transfer of a measurement signal from the period into the frequency space, can also be used in this regard without further ado.

In order to be able to provide a rolling parameter online in a relatively simple and reliable manner, a method for the online detection of at least one rolling parameter when rolling a rolled material along a rolling line within a rolling mill comprising at least two rollers on a rolling stand, where the rolled material is passed by at least one measurement device during rolling or passed through it, which interacts with a varying rolled material parameter of the rolled material along the longitudinal extension of the rolled material and outputs a measurement signal, cumulatively or alternatively is characterized in that a frequency inherent to the change of the parameter is detected from the measurement signal, and the rolling parameter is detected on the basis of the specified frequency.

In order to determine from the measurement signal, a frequency inherent to the change of parameter, as already explained above, for example, a transfer to the frequency space, can take place. Even this is relatively easy and reliable to carry out. On the other hand, it is also conceivable that suitable filters are used to search specifically for certain frequencies, which may lead to even faster frequency detections. Accordingly, it is to be understood that any suitable, known method can be used for frequency detection, with which frequencies that are significant in this context can be detected from a measurement signal.

Cumulatively or alternatively to this, a rolling parameter can be provided relatively easily and reliably online if a rolling mill which comprises at least two rollers arranged on a rolling stand for rolling rolled material along a rolling line and a device for the online detection of at least one rolling parameter, in which the detection device comprises at least one measurement device, which is arranged on the rolling line and which can interact with a varying rolled material parameter along the longitudinal extension of the rolled material and can output a measurement signal, cumulatively or alternatively is characterized in that the detection device comprises a means for frequency analysis.

As already explained above, a frequency analysis and, accordingly, also by means of frequency analyzing means, a frequency inherent to the change of the rolled material parameter can be detected from the measurement signal relatively easily and reliably. Accordingly, this enables the rolling parameter to be detected relatively easily and reliably on the basis of the specified frequency. The frequency detection can be carried out here—as already explained above—in particular, by means of filters or other suitable measures of the frequency analyzing means. In particular, the frequency analyzing means can then also provide for a transfer of the measurement signal into the frequency space in order to then be able to determine the rolling parameter from the measurement signal transferred to the frequency space.

For the detection of the rolling parameter, the circumferential speed, the rotation frequency and/or the rolling speed of at least one of the rollers can additionally be used. This allows a comparison in the evaluation of the measurement signal with other rolling parameters, which are relatively precisely accessible to be able to determine the rolling parameter to be detected online, which may otherwise be very difficult to access. It is to be understood that, if necessary, also concerning the circumferential speed, the rotational frequency and/or the rolling speed, proportional variables can be used accordingly to determine the rolling parameter to be detected. Here it is usually ultimately a question of the conversion constants, which then enable an assignment of the measurement signals to each other to determine the respective rolling parameter.

The circumferential speed of a roller can be relatively simple according to the formula:

$$v_{roll}=f_{roll}\cdot\pi\cdot d_{roll} \tag{1}$$

to transfer into the frequency space and express $f_{roll}$ through the rotational frequency $f_{roll}$—and vice versa. With regard to the rolling speed of a roller, this can be done in a similar way, wherein this is relatively difficult to detect directly from a metrological point of view. It is to be understood however, that other rolling parameters, such as pressure forces acting on the rollers, rolling grooves measured in any way and adjustment positions of the rollers, can also be used accordingly to detect the desired rolling parameter.

During rolling, if the rolling process is designed accordingly, material of the rolled material can be moved along its longitudinal extension. This then has the consequence that the rolled material behind a rolling stand, with which this deformation is applied, usually moves at higher rolled material speeds than the circumferential speed or rolling speed of the rollers of the corresponding rolling stand. This effect, called "peripheral precession $K_f$", relates the circumferential speed $v_{roll}$ of the corresponding roll or corresponding rollers to the rolled material speeds $v_{rod}$ of the rolled material behind the associated rolling stand.

$$\kappa_f = \frac{v_{rod} - v_{roll}}{v_{roll}} \cdot 100 = \left(\frac{v_{rod}}{v_{roll}} - 1\right) \cdot 100 \tag{2}$$

which, taking into account that the rolled material speeds $v_{rod}$ of the rolled material is then greater than the circumferential speed $v_{roll}$ of the corresponding roller in such a way that the peripheral precession $K_f$ is then usually accordingly positive, $$\kappa_f = \left(\frac{f_{rod}}{f_{roll}} - 1\right) \cdot 100 \cdot (-1), \tag{3}$$

can also be transferred into the frequency space,

A factor −1 must be taken into account here, since the frequency of the cross-sectional surface change of the rolled material, which is to be assigned to the rolled material velocity $v_{rod}$ of the rolled material, is then less than the frequency $f_{roll}$ of the unwinding of the roller, i.e., the circumferential speed $v_{roll}$, which, in this context, would otherwise lead to a negative peripheral precession $K_f$.

In rarer cases, the peripheral precession $K_f$ can also be negative, but this would then also lead to the factor (−1) in order to be able to correctly map the ratios in the equations (2) and (3).

Thereby, via the equation of the peripheral precession $K_f$ $$\frac{v_{rod} - v_{roll}}{v_{roll}} = \left(1 - \frac{f_{rod}}{f_{roll}}\right) \tag{4}$$

$$\frac{v_{rod} - v_{roll}}{v_{roll}} = \left(\frac{f_{roll} - f_{rod}}{f_{roll}}\right) \tag{5}$$

$$v_{rod} = \left(\frac{f_{roll} - f_{rod}}{f_{roll}}\right) v_{roll} + v_{roll} \tag{6}$$

$$v_{rod} = (f_{roll} - f_{rod}) \cdot \pi \cdot d_{roll} + f_{roll} \cdot \pi \cdot d_{roll} \tag{7}$$

$$v_{rod} = (2f_{roll} - f_{rod}) \cdot \pi \cdot d_{roll} \tag{8}$$

the rolled material velocity $v_{rod}$ of the rolled material behind a rolling stand can then be determined on the basis of the frequency $f_{roll}$ detected from the measurement signal or on the basis of the measurement signal transferred into the frequency space.

It is also understood that the peripheral precession $K_f$ can therefore be detected directly online as a rolling parameter.

As a further rolling parameter, or as a further measurement signal, which must be used for this purpose, only the circumferential speed $v_{roll}$ or the rotational frequency $f_{roll}$ or, if necessary, the rolling speed is to be detected, wherein such detections are ultimately sufficiently known from the prior art.

Accordingly, both the peripheral precession $K_f$ as well as the rolled material speed $v_{rod}$ of the rolled material behind a rolling stand—and if a plurality of rolling stands is used, also for each individual rolling stand—can be detected. However, tensile changes can also be detected online. It is also conceivable to determine friction coefficient and/or neutral point changes online. All of these variables are currently only available offline, and thus—naturally—also not between the individual rolling stands.

It is to be understood that, in particular, by measuring a varying rolled material parameter along the longitudinal extension of the rolled material, in particular, if this is introduced into the rolled material with the periodicity of one or a plurality of rollers, and the transfer of the corresponding measurement signal into the frequency space, a frequency analysis of the corresponding measurement signal and/or detection of a frequency inherent to the rolled material parameter from the measurement signal also further makes new aspects for online or in-situ diagnosis of a rolling process possible. In particular, this diagnosis can be carried out easily and reliably and, with appropriate embodiment, also very quickly so that the results can also be used online or in-situ to control or regulate the rolling process accordingly.

From the prior art, it is sufficiently known to control at least one of the rollers in a rolling mill via a control device. This can be, for example, a roll adjustment by means of which the rollers can be adjusted towards or away from the rolling line in order to influence the rolling groove in this way. A corresponding adjustment can be made, for example, by applying certain forces or also by a corresponding positioning of the rollers. Likewise, the control device can allow a roller drive and thus an adjustment of the circumferential speed, the rotation frequency or the rolling speed. In the present context, a control device comprises, in particular, all means and devices of a rolling mill with which the behavior of the rollers in relation to the rolled material can be changed, preferably, specifically changed.

Preferably, a control device for at least one of the rollers is operationally connected to the detection device so that the detected rolling parameter and/or the certain frequency can be used as a control parameter for the control device. Here, it is also to be understood that, if necessary, the circumferential speed, the rotational frequency and/or the rolling speed or a proportional parameter as well as other rolling parameters can be used in this regard for the control.

In particular, it is favorable if the control device and the detection device are connected to each other in a control loop so that the control of the corresponding roller can be controlled via a control loop, which uses the measurements of the detection device and/or the detected rolling parameter accordingly for the control.

It is to be understood that, if necessary, a plurality of or all rollers of the corresponding rolling mill can also be controlled or regulated accordingly.

Preferably, the measurement device is arranged in a stationary manner in relation to the rolling mill at least during rolling. This enables the rolled material to be guided past or passed through the measurement device relatively quickly and yet relatively accurate measured values can be recorded. In addition, this provides predictably reliable measurement results, which can then also provide the respective rolling parameter online in a correspondingly simple and reliable manner.

It is also cumulatively or alternatively favorable if the measurement device measures perpendicular to the rolling line across the circumference of the rolled material in an integrating and/or averaging manner. This also enables a relatively fast and reliable measurement, even if this dispenses with a spatial resolution that would otherwise be possible around the circumference of the rolled material.

In particular, the frequency analysis explained above, the transfer of the measurement signal into the frequency space or the frequency detection from the measurement signal make it still possible for such integrating or averaging measurements to influence one of the two rollers or also all rollers of a rolling stand—and in the case of deeper analysis, possibly even the influence of rollers, which are provided on further preceding rolling stands or even on upstream rolling mills or the influence of other devices acting on the rolled material—in order to be able to determine the rolling parameter to be detected accordingly or even to be able to detect it more precisely.

The measurement device can comprise, in particular, an eddy current sensor and/or an impedance measurement since such measuring methods are particularly suitable for adverse environments, as they are regularly found in rolling mills. It is to be understood that other measurement devices can also be used alternatively or cumulatively, which can therefore ultimately be detected by the rolling parameter to be detected, which ultimately determines the rolled material parameter to be measured for a detection of this rolling parameter.

In particular, an impedance measurement has proven to be advantageous, since such a measurement in the form of a coil enclosing the rolled material on a plane perpendicular to the longitudinal extension of the rolled material can be implemented, which directly leads to a measuring result over the circumference of the rolled material in an integrating and/or averaging manner. In addition, such an impedance measurement can also be carried out in close proximity to the rollers or between rolling stands, although there are very adverse conditions, such as high temperatures, a lot of scale, a lot of dust or a lot of steam, and spatially very limited conditions.

Preferably, at least two measurement devices are arranged along the rolling line, which can accordingly enable a more accurate measurement result. In particular, it is conceivable that one of the measurement devices can be arranged in front of and one of the measurement devices behind the respective rolling stand so that the varying rolled material parameter along the longitudinal extension of the rolled material can be measured in front of a corresponding rolling stand and after this rolling stand. This then enables a corresponding comparison so that an even more precise detection of the corresponding rolling parameter can be possible.

It is to be understood that, depending on specific requirements, appropriate measurement devices may be provided between rolling stands if the rolling line has a plurality of rolling stands. It is also conceivable that only one measurement device can be provided at the end of the corresponding rolling line if this appears sufficient.

Depending on the specific requirements, the measures explained above or in particular the frequency analysis explained here, the transfer of the measurement signal into the frequency space explained here or the frequency detection from the measurement signal explained here can be used with further detection results, such as those of M. Radschun, A. Jobst, O. Kanoun, J. Himmel ("Non-contacting Velocity Measurements of Hot Rod and Wire Using Eddy-Current Sensors", 2019 IEEE Workshop 2019, Mülheim a. d. Ruhr) explained correlations of measurement results in the period, or with other measurement results or rolling parameters detected from this in order to be able to determine further statements about the rolling process or to determine further rolling parameters. It is conceivable that these further detection results or rolling parameters are not obtained in the frequency space and are only then transferred to the frequency space. It is also conceivable that before further processing of the rolling parameters detected by the frequency analysis explained here, the transfer of the measurement signal into the frequency space explained here or the frequency detection from the measurement signal explained here, these are transferred back from the frequency space into the period and only then further processed there.

In particular, it is also conceivable that when using a plurality of measurement devices, for example between the rolling stands or before and after a rolling stand, the respective measurement signals in the frequency space or after a frequency analysis can be correlated. It is also conceivable to correlate such measurement signals according to the frequency detection explained above or with regard to their correspondingly detected frequency. Such correlations can also provide further information about the rolling process, i.e., serve to determine one or a plurality of further rolling parameters.

In the present case, it is favorable if the rolled material is a rod, a wire or a pipe. With such a choice of rolled material, measurements can be implemented in a structurally relatively simple way, in an integrating and/or averaging manner across the circumference of the rolled material. The exact cross-sectional shape of the rod, wire or pipe does not necessarily appear to be essential here if, for example, an impedance measurement or similarly integrating or averaging measurements are to be carried out. In addition, rods or pipes are usually often subject to rolling processes, so that the present invention appears to be versatile here. In particular, larger rolled material or larger semi-finished products, such as slabs, ingots, hollow blocks, or hollows, can also be rolled accordingly and measured accordingly with regard to their rolled material variables instead.

On the other hand, it is to be understood that flat material, such as sheets or strips, can also be used as rolled material, provided that a suitable choice of the associated measurement device is made here.

Preferably, the rolled material is metallic since, in particular in metallic rolled material, corresponding rolling processes take place under extremely adverse environmental conditions so that, here, correspondingly difficult rolling parameters, which can be used, in particular, for a control of rollers or otherwise in a control loop, can also be detected. However, metallic rolled material in particular enables impedance or eddy current measurement, for example, by means of a coil surrounding the rolled material located on the rolling line.

In the present context, it should be noted in the frequency analysis, in particular, in the frequency space, and/or when detecting the frequency, that the measured rolled material parameter is preferably introduced into the rolled material with a frequency corresponding to the rotation of the rollers, which, compared to rolled material variables that are introduced into the workpiece, for example, by an inherent rotation of the workpiece, leads to significantly higher frequencies of the corresponding rolled material variables, wherein these can possibly also be detected by the devices or methods explained here, but then, it is not a matter of determining the natural rotational frequency, which naturally cannot represent a rolled material parameter that can change across the longitudinal extension of the rolled material.

As already indicated above, any corresponding rolled material parameter of the rolled material can be used as a varying rolled material parameter of the rolled material along the longitudinal extension of the rolled material as long as this is sufficiently influenced by the rolling process, in particular, by the rollers. In particular, varying rolled material variables along the longitudinal extension of the rolled material come into question, which cause periodic changes in the rolled material directly caused by the rolling process of the associated rollers on the rolled material or which are introduced into the rolled material by rolling off at least one of the rollers on the rolled material. Such periodic changes may be caused, for example, by errors in the rollers, by roundness imperfections or by natural frequencies or residual stresses of the respective roller or the associated rolling stand.

It is to be understood that the features of the solutions described above or described in the claims can also be combined, where applicable, in order to be able to implement the advantages in a cumulative manner.

BRIEF DESCRIPTION OF THE DRAWINGS

Further advantages, objectives and characteristics of the present invention are explained on the basis of the following description of exemplary embodiments, which are also shown, in particular, in the adjacent drawing. The figures show.

DETAILED DESCRIPTION OF THE PREFERRED EMBODIMENTS

Figure 1:
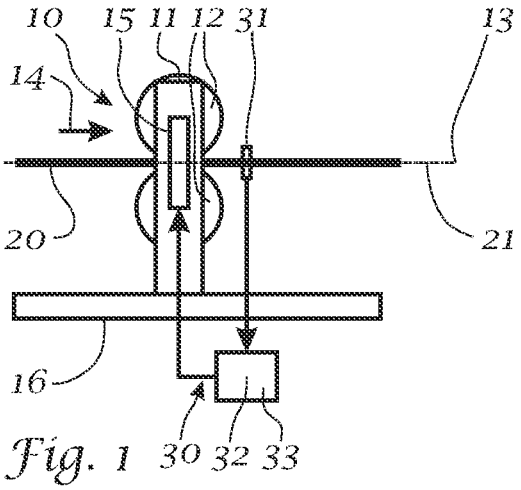
FIG. 1 a first rolling mill in schematic side view.
Figure 2:
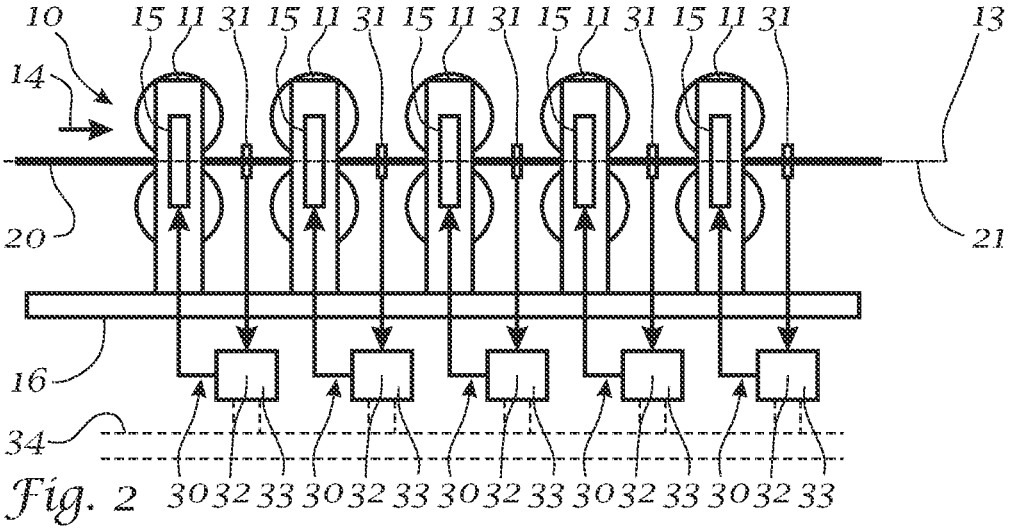
FIG. 2 a second rolling mill in schematic side view.
Figure 3:
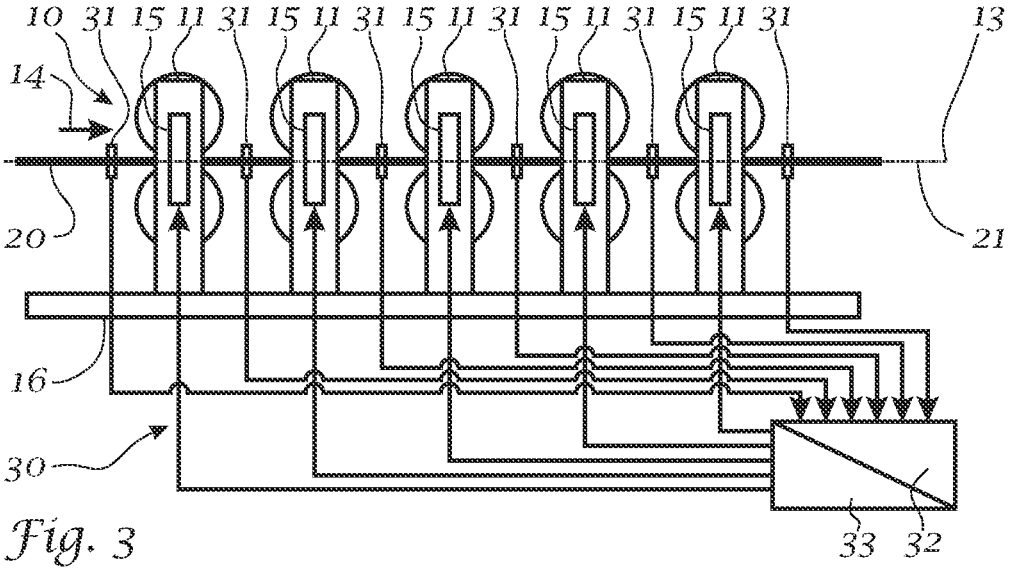
FIG. 3 a third rolling mill in schematic side view.

The rolling mills 10 shown in FIGS. 1 to 3 each have rolling stands 11 which support rollers 12 and can roll a rolled material 20 in the rolling direction 14 along a rolling line 13.

Here, rolling mill 10 in accordance with FIG. 1 only comprises such a rolling stand 11, while rolling mills 10 in accordance with FIGS. 2 and 3 each have five such rolling stands 11. In deviating embodiments, other numbers on rolling stands 11 can be provided here, wherein the distances of the rolling stands 11 and the number of rollers 12, which support the respective rolling stands 11, and their arrangement around the rolling line 13 can also be selected differently depending on the specific rolling mill 10.

The rolling mill 10 of the present exemplary embodiments each comprises a stand 16 on which the rolling stands 11 are held. It is to be understood that depending on the specific rolling mill 10, stand 16 can be designed as a building part, as a rolling stand girder, as a frame or the like.

For each rolling stand 11, rolling mills 10 comprise a control device 15 by means of which the rollers 12 can be controlled. In this exemplary embodiment, the control devices 15 each comprise adjusting means, via which the rollers 12 can be adjusted perpendicular to the rolling line 13 in order to adapt them to a specific rolling groove or to a certain rolled material 20. In addition, the control devices 15 also include a drive for the rollers 2, so that they can drive the rolled material 20 through the rolling mill 10 along the rolling line 13 in rolling direction 14.

It is to be understood that, depending on the specific embodiment, the corresponding rolling mill 10 can also comprise otherwise effective control devices 15, for example, for only some of the rollers 12, brakes, cooling, heaters or the like, which can accordingly influence the rolling process. In particular, not all of the rollers 12 have to be driven, but it is conceivable that the rollers 12 can also only run along where applicable.

Rolling mills 10 are each designed for rolled material 20, which extends in a longitudinal extension 21, which is essentially aligned parallel to rolling line 13. In the specific rolling process, an attempt will be made to align the longitudinal extension 21 of the rolled material 20 as far as possible on the rolling line 13. However, minor deviations cannot be ruled out here due to unavoidable tolerances and, if necessary, due to the cross-section of the rolled material 20.

Rolling mills 10 can easily be used for sheet or strip-shaped rolled material 20. In the present case, however, rolling mills 10 are designed, in particular, for rod, wire or tubular rolled material 20.

Rolling mills 10 each have detection devices for the online detection of at least one rolling parameter.

In this case, the detection device comprises at least one measurement device 31 in each case, which is provided behind a rolling stand 11. In the case of rolling mill 10 shown in FIG. 3, a measurement device 31 is also provided—as an example—in front of the first rolling stand 11 in the rolling direction 14.

Measurement devices 31 are designed to interact with a varying rolled material parameter of rolled material 20 along the longitudinal extension 21 of the rolled material 20 and to output a corresponding measurement signal 40.

In the present exemplary embodiment, an impedance measurement is carried out by the measurement devices 31 by a coil aligned perpendicular to the rolling line 13, which surrounds the rolling line 13—and thus also the rolled material 20, if this runs along the rolling line 13. As a result, an impedance measurement can be carried out, which ultimately directly represents a measure for the respective cross-sectional area of the rolled material 20 so that, in this exemplary embodiment, the cross-sectional surface change of the rolled material 20 in its passing of the respective measurement devices 31 or in its passage through the respective measurement devices 31 represents the rolling parameter to be detected. In this cross-sectional area change, the influences of rollers 12 or also of other tools that act or have acted on the rolled material 20 can be found to be variable over the longitudinal extension 21 of the rolled material 20.

It is to be understood that in the case of alternative rolled material 20, other rolled material variables may also be relevant or differently designed measurement devices 31 can be used.

Figure 4:
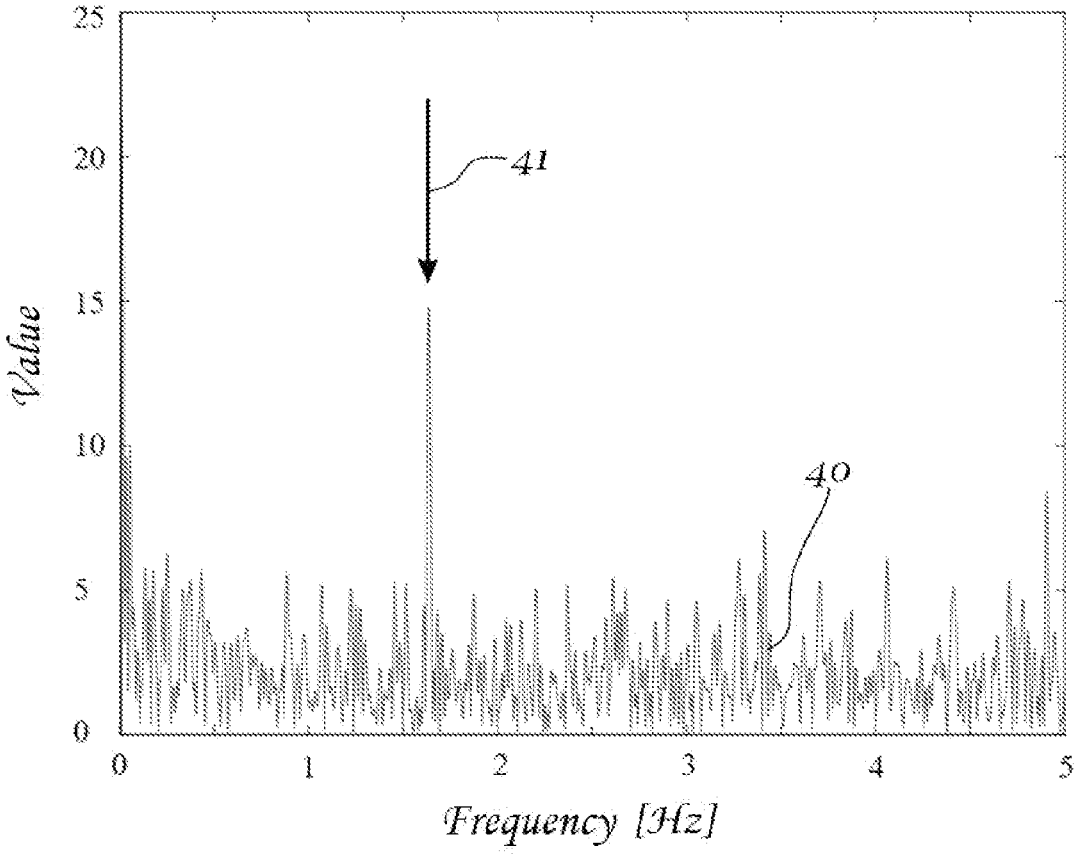
FIG. 4 as an example, the frequency spectrum of a rod-shaped rolled material, which can be recorded with a measurement device of the rolling mills in accordance with FIGS. 1 to 3.

Via the frequency analyzing means 32 of the detection device 30, for example, by the corresponding measurement signal 40, as exemplified in FIG. 4, being transferred into a frequency space, a specific frequency 41 inherent in the change in the parameter of the rolled material, i.e., the cross-sectional area, can be detected. This frequency, which clearly appears in FIG. 4, can then be used to determine the rolling parameter rolled material velocity $v_{rod}$ of the rolled material 20 according to equation (8) or also the rolling parameter peripheral precession $K_f$ according to equation (3)— for each individual rolling stand 11, insofar as the circumferential speed $v_{roll}$ of the corresponding rollers 12, which are upstream of the respective measurement device 31, or whose rotational frequency $f_{roll}$ is measured accordingly, taking the equation (1) into account. Where applicable, tensile changes or friction coefficient and neutral point changes can also be detected accordingly online.

It is to be understood that in deviating embodiments a more detailed analysis of the measurement signal 40 can be carried out in order to be able to determine further or alternative rolling parameters. Where applicable, further measurement devices or other measurement devices can also be provided for this purpose.

It is also conceivable that the measurement signals 40 of the measurement devices 31 are used for further purposes, for which in the exemplary embodiment in FIG. 2 a bus 34 is provided, which connects individual computing units 33, in which the frequency analyzing means 32 of the individual rolling stands 11 and an output unit to the control device 15 are respectively converted. As a result, in particular, the measurement signals 40 of a measurement device 31 or the rolling parameters detected by a computing unit 33 can also be made available to other computing units 33.

In the exemplary embodiment shown in FIG. 3, a central computing unit 33 serves to output signals to the control device 15, while a central frequency analyzing means 32, which is separately formed from the computing unit 33, analyses all measurement signals of the measurement devices 31 accordingly.

It is to be understood that, in different embodiments, combinations, which deviate and are almost arbitrary here, composed of a bus 34, computing units 33 and frequency analyzing means 32 can be provided, since it ultimately only depends on the fact that corresponding frequency analyzing means 32 and computing units 33 must be available for the respective measurement devices 31.

It is to be understood that—depending on the specific embodiment of the respective computing unit 33—this can comprise frequency analyzing means 32 without further ado. It is also conceivable that a separate computing unit comprises the frequency analyzing means 32. It is also conceivable that the signal forwarding of the respective computing unit 33 to the control device 15 or the control devices 15 can be carried out by a separate computing unit 33 or by a computing unit 33 that can be repeatedly or additionally used elsewhere.

| Reference list: | |
|---|---|
| 10 | rolling mill |
| 11 | rolling stand |
| 12 | roller |
| 13 | rolling line |
| 14 | rolling direction |
| 15 | control device |
| 16 | stand of rolling mill 10 |
| 20 | rolled material |
| 21 | longitudinal extension of rolled material 20 |
| 30 | detection device |
| 31 | measurement device |
| 32 | frequency analysing means |
| 33 | computing unit |
| 34 | bus |
| 40 | measurement signal |
| 41 | certain frequency |

The invention claimed is:

1. A method for the online detection of at least one rolling parameter when rolling a rolled material (20) rolled along a rolling line (13) in a rolling mill (10) comprising at least two rollers (12) on a rolling stand (11) where the rolled material (20) is a rod or a pipe and where rolled material (20) is passed by or passed through at least one measurement device (31) during rolling, which measures a varying rolled material parameter of the rolled material (20) along the longitudinal extension (21) of the rolled material (20) and outputs a measurement signal (40), wherein the measurement device (31) measures perpendicular to the rolling line (13) across the circumference of the rolled material (20) in an integrating and/or averaging manner and (i) the measurement signal (40) is transferred to the frequency space and the rolling parameter is detected from the measurement signal transferred to the frequency space (40), and/or (ii) a frequency inherent in the change in said rolled material parameter of the rolled material (41) is detected from the measurement signal (40), while said rolled material (20) is passing by or passing through said measurement device (31) during rolling, and wherein said rolling parameter is detected on the basis of said frequency (41) detected from the measurement signal (40).

2. The detection method according to claim 1, wherein for the detection of the rolling parameter additionally a circumferential speed, a rotational frequency and/or a rolling speed of at least one of the rollers or a proportional parameter is used.

3. The detection method according to claim 2, wherein at least one of the rollers (12) of the rolling stand (11) is controlled depending on the frequency (41) detected from the measurement signal (40) and/or the detected rolling parameter and by the circumferential speed, the rotational frequency and/or the rolling speed of at least one of the rollers (12) or by a proportional parameter.

4. The detection method according to claim 1, wherein at least one of the rollers (12) of the rolling stand (11) is controlled depending on the frequency (41) detected from the measurement signal (40) and/or the detected rolling parameter.

5. The detection method according to claim 1, wherein the measurement device (31) is stationary in relation to the rolling mill (10) at least during rolling.

6. The detection method according to claim 1, wherein the measurement device (31) comprises an eddy-current sensor and/or an impedance measurement.

7. The detection method according to claim 1, wherein at least two measurement devices (13), preferably one before and one behind the rolling stand (11), are arranged along the rolling line (13).

8. The detection method according to claim 1, wherein the rolled material (20) is metallic.

9. A rolling mill (10) comprising at least two rollers (12) arranged on a rolling stand (11) for rolling rolled material (20) along a rolling line (13) and a device (30) for online detection of at least one rolling parameter, wherein the rolled material (20) is a rod or a pipe and wherein the detection device (30) comprises at least one measurement device (31) which is arranged on the rolling line (13) and is configured to measure a varying rolled material parameter of the rolled material (20) along the longitudinal extension (21) of the rolled material and to output a measurement signal (40), wherein the measurement device (31) measures perpendicular to the rolling line (13) across the circumference of the rolled material (20) in an integrating and/or averaging manner and the detection device (30) comprises means (32) for frequency analysis analyzing a change of said varying rolled material parameter of the rolled material.

10. The rolling mill (10) according to claim 9, wherein a control device (15) for at least one of the rollers (12) is connected to the detection device (30).

11. The rolling mill (10) according to claim 9, wherein the control device (15) and the detection device (30) are connected to each other in a control loop.

12. The rolling mill (10) according to claim 9, wherein the measurement device (31) is stationary in relation to the rolling mill (10) at least during rolling.

13. The rolling mill (10) according to claim 9, wherein the measurement device (31) comprises an eddy-current sensor and/or an impedance measurement.

14. The rolling mill (10) according to claim 9, wherein at least two measurement devices are arranged along the rolling line (13).

15. The rolling mill (10) according to claim 9, wherein the rolled material (20) is metallic.

16. The rolling mill (10) according to claim 9, wherein a first measurement device is arranged in front of the rolling stand and a second measurement device is arranged behind the rolling stand (11) along the rolling line (13).

* * * * *